US005807214A

United States Patent [19]

Riazi

[11] Patent Number: 5,807,214

[45] Date of Patent: Sep. 15, 1998

[54] CONNECTOR FOR SECURING AN EXERCISE MEMBER

[75] Inventor: John Riazi, Akron, Ohio

[73] Assignee: The Hygenic Corporation, Akron, Ohio

[21] Appl. No.: 813,795

[22] Filed: Mar. 6, 1997

[51] Int. Cl.[6] ..... A63B 21/02

[52] U.S. Cl. ..... 482/129; 482/904; 24/196

[58] Field of Search ..... 482/904, 140, 482/129; 224/250; 24/265 R, 200, 196

[56] References Cited

U.S. PATENT DOCUMENTS

| | | | |
|---|---|---|---|
| 2,931,629 | 4/1960 | Keller . | |
| 3,206,816 | 9/1965 | Vilcins et al. | 24/200 |
| 3,336,639 | 8/1967 | Rutty et al. | 24/200 |
| 3,510,132 | 5/1970 | Holkesvick . | |
| 4,761,861 | 8/1988 | Peles | 24/196 |
| 4,809,974 | 3/1989 | Buhr . | |
| 4,909,505 | 3/1990 | Tee . | |
| 5,052,365 | 10/1991 | Carella . | |
| 5,254,065 | 10/1993 | Pollock . | |
| 5,318,494 | 6/1994 | Santighian . | |
| 5,325,568 | 7/1994 | Bruhm | 24/265 R |
| 5,426,829 | 6/1995 | Hsiung | 24/196 |

FOREIGN PATENT DOCUMENTS 22796 11/1904 United Kingdom .

*Primary Examiner*—Lynne A. Reichard
*Attorney, Agent, or Firm*—Renner, Kenner, Greive, Bobak, Taylor & Weber

[57] ABSTRACT

A connector (10) for securing an exercise member (12) to a section of flexible material (18) includes a slide (50) and first (20) and second (22) cinchable loops. First (20) and second (22) cinchable loops are formed in the material (18) and in cooperation with the slide (50) and are connected by a third loop (24). The third loop (24) has a first end (30) and a second end (32) that are restrained by a restraint (40). The restraint (40) prevents the first (20) and second (22) cinchable loops from pulling out of the frame (50). The connector (10) secures an exercise member (12) by holding the exercise member (12) in the two cinchable loops (20,22). The connector (10) may also be used to anchor an exercise member (12) to a door (300), a door hold (16), or a hand hold (14). Multiple connectors (10) may also be used in conjunction with a single section of material (18) to provide additional and varying exercise device configurations.

17 Claims, 12 Drawing Sheets

CONNECTOR FOR SECURING AN EXERCISE MEMBER

TECHNICAL FIELD

This invention relates to the art of exercise devices and, more particularly, to exercise devices that employ an extensible member to provide resistance to the muscle group being exercised. Specifically, the present invention is directed toward a connector for securing an exercise member by providing a pair of joined, cinchable loops through which the exercise member may be passed.

BACKGROUND OF THE INVENTION

Numerous exercise devices known today employ extensible members to provide resistance to the person using the device. Perhaps the simplest of such a device is a simple length of elastic material that is grasped at either end with the hands. The person then elongates the elastic member to exercise the muscles. A problem with such a configuration is that an elastic member is difficult to grasp while applying a large amount of force.

Thus, numerous configurations and devices have been developed to assist a person in applying force to an elastic member. Some of these configurations require uniquely configured extensible members such as those having receiving holes or protuberances. Other devices that use metal clamps that bite into the material may eventually permanently damage the material. Another problem with some devices is the relatively long amount of time required to change elastic members or add another elastic member to vary the resistance provided by the device.

It is thus desired to provide a device that assists a person in gripping an elastic or extensible member that easily connects to and does not damage the elastic member.

SUMMARY OF INVENTION

An object of the invention is, therefore, to provide a connector for securing an exercise member that secures exercise members of various cross-sections and sizes.

Another object of the present invention is to provide a connector for securing an exercise member, as above, that may be incorporated into different handle or anchor configurations.

A further object of the present invention is to provide a connector for securing an exercise member, as above, that may be incorporated directly into a section of flexible material, such as a band of braided nylon.

Yet another object is to provide a connector for securing an exercise member, as above, that may be slid along the flexible material when the connector is formed in the material.

At least one or more of the foregoing objects, together with the advantages thereof over existing and prior art forms, which will be apparent in view of the following detailed description, are accomplished by means hereinafter described and claimed.

In general, the present invention provides a connector for securing an exercise member to a flexible material, the connector including a slide; first and second cinchable loops formed in the flexible material in cooperation with the slide; a third loop connecting the first and second cinchable loops; the third loop having a first end and a second end; and a restraint holding the first end and the second end of the third loop; the first and second cinchable loops being adapted to receive a portion of the exercise member.

The present invention also provides a connector for securing an exercise member to a flexible material in combination with an exercise member, the combination including an exercise member; a slide; first and second cinchable loops formed in the material in cooperation with the slide; a third loop connecting the first and second cinchable loops; the third loop having a first end and a second end; a restraint holding the first end and second end of the third loops; the exercise member passing through both of the first and second cinchable loops.

The present invention further contemplates a handle for holding an exercise member, the handle including a closed loop of material; a slide disposed on the closed loop; first and second cinchable loops formed in the loop in cooperation with the slide; a third loop connecting the first and second cinchable loops; the third loop having a first end and a second end; and a restraint holding the first end and the second end of the third loop; the first and second cinchable loops being adapted to receive a portion of the exercise member.

Another embodiment of the present invention provides a handle for holding an exercise member, the handle including a flexible material having a first end and a second end; a pair of slides disposed on the material; a first connector formed in the first end of the material in cooperation with one of the slides; a second connector formed in the second end of the material in cooperation with the other of the slides; each of the connectors including first and second cinchable loops formed in the material in cooperation with the slide, the cinchable loops adapted to receive a portion of the exercise member, a third loop formed in the material connecting the cinchable loops, the third loop having first and second ends, and a restraint holding the first end and the second end of the third loop.

A further embodiment of the present invention provides an anchor for securing an exercise member between a doorjamb and a door, the anchor including a flexible material having a first end and a second end; a door hold carried by the material; a connector formed in the material; the connector including a slide disposed on the material, a pair of cinchable loops formed in the material in cooperation with the slide, the cinchable loops adapted to receive the exercise member, a third loop formed in the material, the third loop connecting the cinchable loops, the third loop having a first end and a second end, and a restraint holding the first end and the second end of the third loop.

Still another embodiment of the present invention provides an anchor for securing an exercise member to a door, the anchor including a material having first and second ends, the material adapted to wrap around the door; a clamp carried by one of the ends of the material selectively connecting the first and second ends of the material; a connector formed in the material, the connector including a slide disposed on the material, a pair of cinchable loops formed in the material in cooperation with the slide, each of the cinchable loops adapted to receive the exercise member, a third loop formed in the material, the third loop connecting the pair of cinchable loops, the third loop having a first end and a second end, and a restraint holding the first end and the second end of the third loop.

Two exemplary connectors embodying the concepts of the present invention are disclosed in various useful configurations. The description of these embodiments and configurations is deemed sufficient to effect a full disclosure of the subject invention, the exemplary embodiments being shown by way of example in the accompanying drawings and being described in detail without attempting to show all of the various forms and modifications in which the invention might be embodied—the invention being measured by the appended claims and not by the details of the specification.

PREFERRED EMBODIMENT FOR CARRYING OUT THE INVENTION

Figure 21:
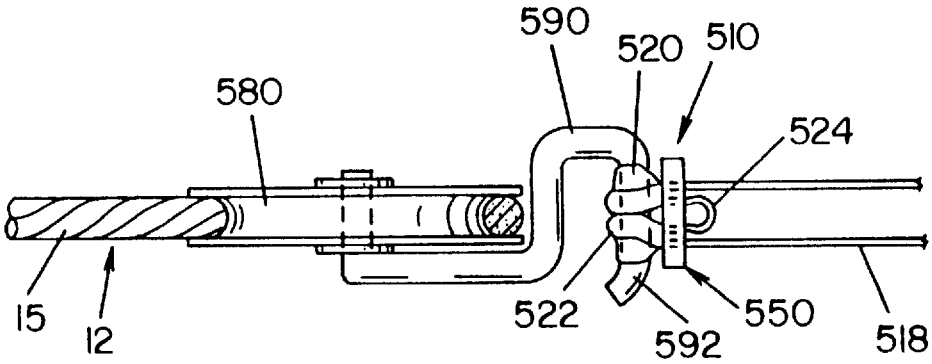
FIG. 21 is a front elevation, partially in section, of the pulley and connector taken substantially along line 21—21 of FIG. 20.

A first embodiment of the connector of the present invention may be specifically seen in FIGS. 1–7 and is indicated generally by the numeral 10. As show in FIG. 1, the connector 10 may be used to secure an exercise member 12 to a device such as a handhold 14 or a door hold 16. In various embodiments, the connector may be used to secure either an extensible member 13, or an inextensible member 15 (FIGS. 19–21), as will be described hereinbelow.

The connector 10 is at least partially formed from a section of flexible material 18. One such flexible material 18 that has been found to be useful is a band of braided nylon but numerous other materials known to those skilled in the art will also function with the present invention. In the embodiment depicted in the drawing figures, the material 18 is in the form of a band that has a substantially flat, rectangular cross-section. Materials 18 having other cross-sections are also contemplated by the present invention.

Figure 2:
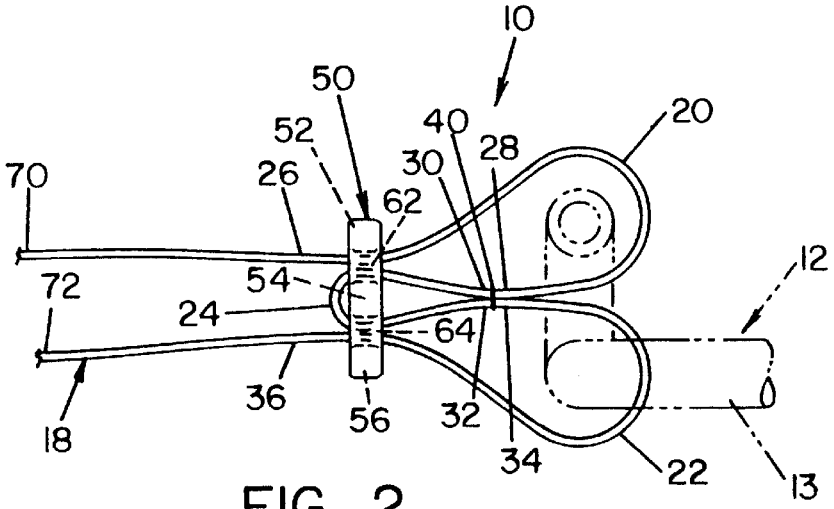
FIG. 2 is a top plan view of one embodiment of the connector according to the concepts of the present invention.
Figure 3:
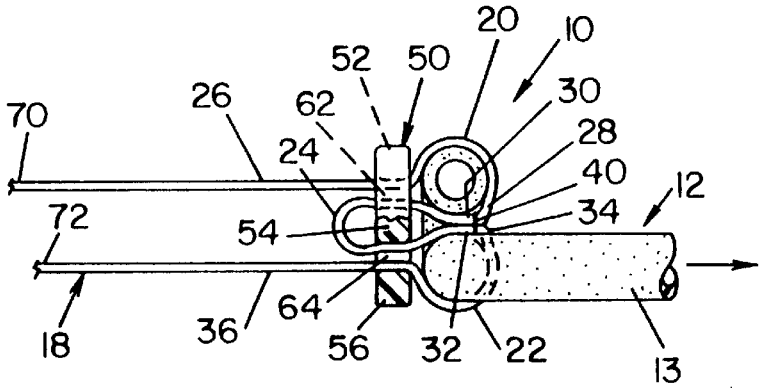
FIG. 3 is a side elevation, partially in section, depicting one embodiment of the connector of the present invention cinched on an exercise member.
Figure 4:
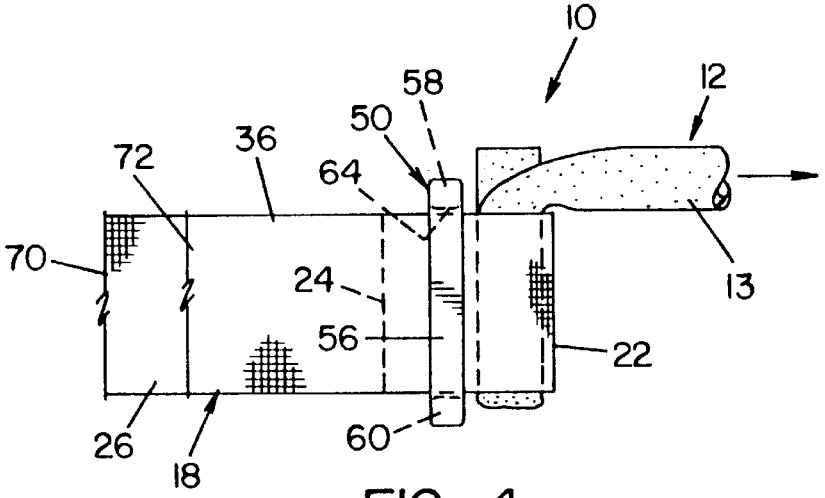
FIG. 4 is a side elevation of the connector depicted in FIG. 3.

Turning now to FIG. 2, the connecter 10 includes a pair of cinchable loops 20, 22 through which the exercise member 12 is inserted. The loops 20, 22 are joined by a third loop 24 that has a substantially constant circumference. The first cinchable loop 20 has a first end 26 and a second end 28. The second end 28 of the loop 20 is connected to a first end 30 of the third loop 24. A second end 32 of the third loop 24 is connected to a second end 34 of the second cinchable loop 22. A first end 36 of the second cinchable loop 22 and the first end 26 of the first loop 20 may be directly joined or extra sections of flexible material 18 may be connected to the first ends 26, 36 of the loops 20, 22. The ends 70, 72 of the extra sections of the material 18 may then be connected in various manners as will be discussed below (see FIG. 11). Thus, the length of configuration of the material 18 between the first ends 26, 36 depends on the intended application of the connector 10.

The circumference of the third loop 24 is substantially constant because the ends 30, 32 of the third loop 24 are restrained by an appropriate device 40. One device that may be used is a plurality of stitches 40 that function as a restraint to hold the ends 30, 32 together and thus prevent the second ends 28, 34 of the loops 20, 22 from pulling out of a slide 50. In the first embodiment of the present invention, the third loop 24 must be wrapped around the slide 50 before the ends 30, 32 are joined. The present invention also contemplates other methods and devices than the disclosed stitches 40 for restraining the ends 30, 32. For example, the ends 30, 32 may be restrained by stapling, tying, weaving, gluing, knotting, or any of the other known methods.

Figure 1:
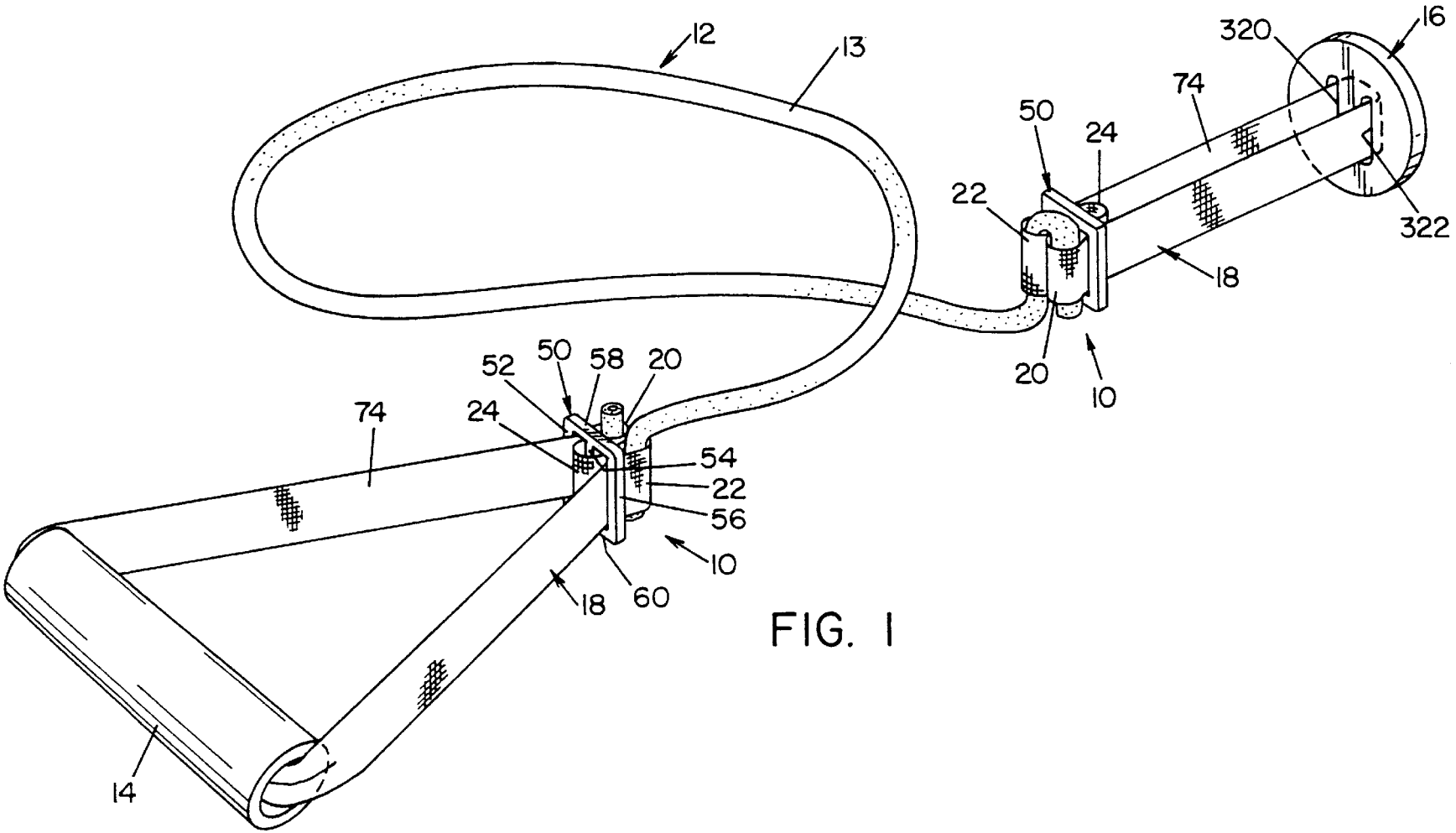
FIG. 1 is a perspective view of an exercise member being secured by two connectors according to the present invention between a hand hold and a door hold.

The slide 50 includes three rails 52, 54, and 56 joined by two stiles 58, 60 to form two openings 62, 64. Each opening 62, 64 is generally configured to match the cross section of the material 18 which is employed to form the connector 10. Other types of slides 50 are also contemplated by the present invention. For instance, a buckle having two openings would also function to provide the structure required to form the connector 10. The third loop 24 is formed by passing the material 18 through the first opening 62 of the slide 50 and then back through the second opening 64. Two opposed sections of the material 18 are then restrained to form the third loop 24. The ends 70, 72 of the material 18 are then passed back through the respective openings in the slide 50 to form the first 20 and second 22 loops. The ends 70, 72 of the material 18 may then be joined to form a closed loop 74. As shown in FIG. 1, a hand hold 14 or a door hold 16 may be placed over the loop 74 before the ends 70, 72 are joined.

An exercise member 12 can be secured by the connector 10 as will be described hereinbelow with reference first to an extensible member 13. Before proceeding, it is to be noted that the extensible member 13 can be manufactured from a suitable elastomeric polymer, including natural rubber, synthetic rubbers and blends thereof. As for the form of the member, the extensible member 13 depicted in FIGS. 1–5 is a hollow elastic tube. It is also possible to utilize solid rubber configurations and, it is to be appreciated the shape is not necessarily limited to cylindrical, for instance, wide elastic bands are discussed hereinbelow. The extensible member 13 is passed through one of the cinchable loops 20, 22 and then doubled over and passed back through the other cinchable loop 20, 22. The first ends 26, 36 of the loops 20, 22 are then pulled away from the slide 50 to cinch the loops 20, 22 against the extensible member 13. Friction between the loops 20, 22, slide 50, and extensible member 13 keeps the connection from becoming so loose that the extensible member 13 falls out of the connector 10. When in use, the user exerts force against the extensible member 13 and on the first ends 26, 36 of the loops 20, 22. The force applied by the user functions to securely hold the extensible member 13 in the loops 20, 22 against the slide 50. Thus, as the user pulls harder, the connection between the extensible member 13 and the material 18 becomes stronger because the loops 20, 22 are cinched on the extensible member 13 tighter.

Figure 5:
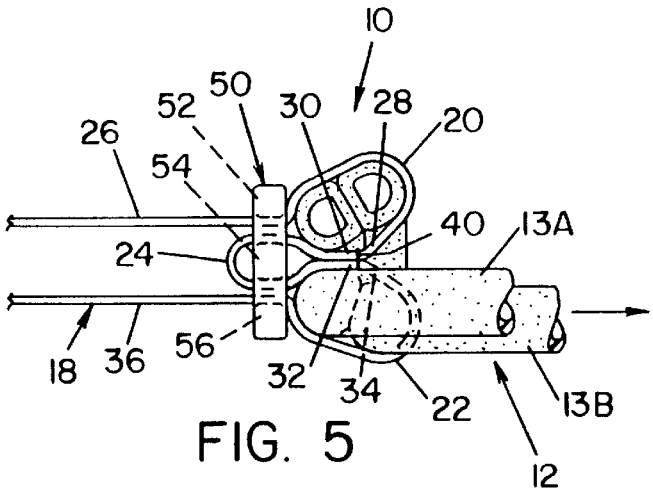
FIG. 5 is a top plan view of one embodiment of the connector cinched on a pair of exercise members.
Figure 6:
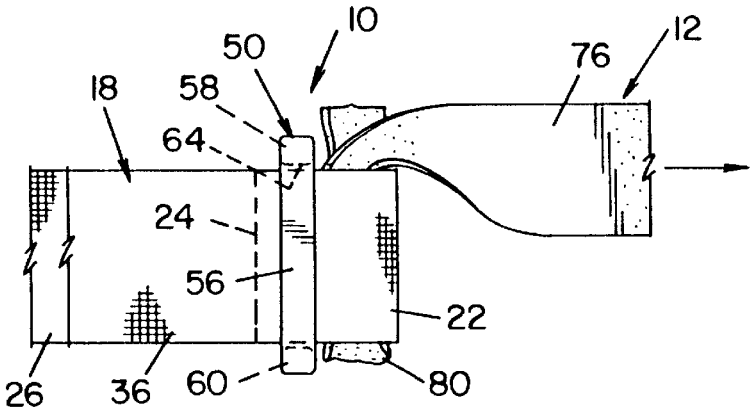
FIG. 6 is a side elevation of one embodiment of the connector according to the concepts of the present invention securing a small band of exercise material.
Figure 7:
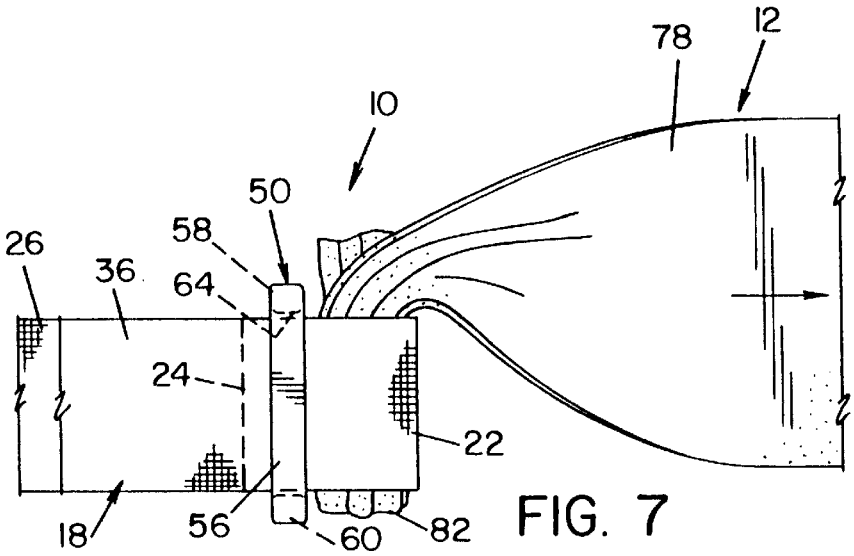
FIG. 7 is a side elevation of one embodiment of the connector according to the concepts of the present invention securing a large band of exercise material.

As shown in FIG. 5, the extensible member may be doubled over or two extensible members 13A and 13B may be used to provide additional resistance to the user. The doubled over portions of both extensible members 13A and 13B are secured by the connector 10 through the same method as explained above. As shown in FIGS. 6 and 7, a wide elastic band 76 and 78 may also be secured by the connector 10. Suitable elastic bands are currently available from the Assignee of record herein, The Hygenic Corporation, and are sold under the registered trademark THERA-BAND. Of course, it is to be appreciated that practice of the present invention is not limited to the use of this particular brand of band, the example having been provided merely to illustrate practice of the invention. In FIG. 6, a medium-width elastic band 76 is secured by connector 10. The band 76 is folded together so that the end 80 fits easily into the loops 20, 22. In FIG. 7, a large-width elastic band 78 is depicted as being secured by the connector 10. The band 78 is simply crimped down at its end 82 until the end 82 fits into the loops 20, 22. The loops 20, 22 are then cinched upon the extensible member 78 to secure it.

Figure 8:
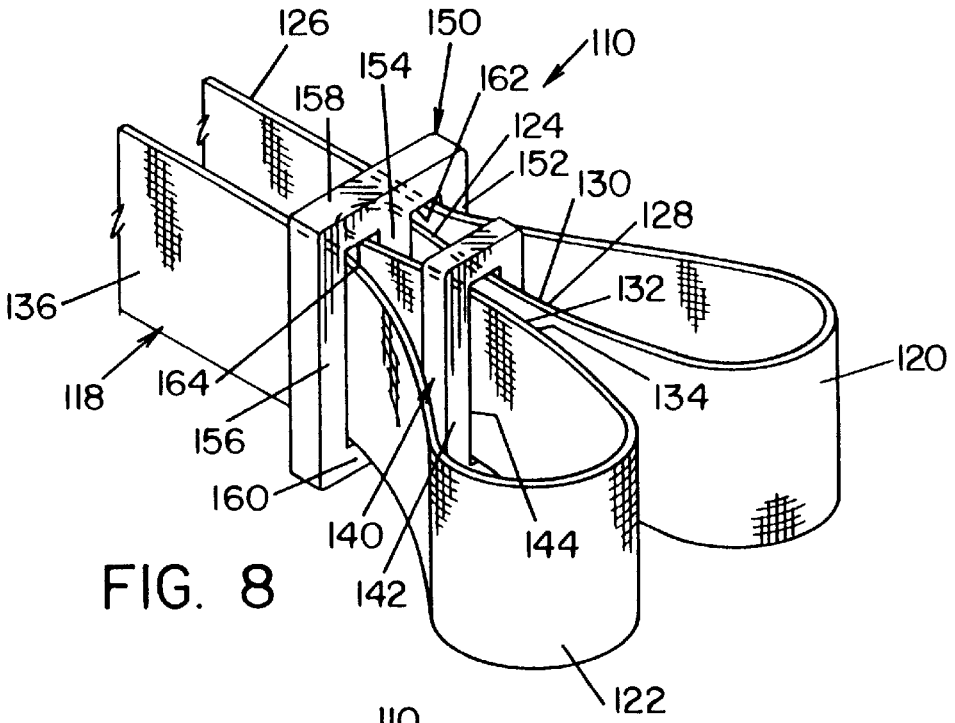
FIG. 8 is a perspective view of a connector according to another embodiment of the present invention.
Figure 9:
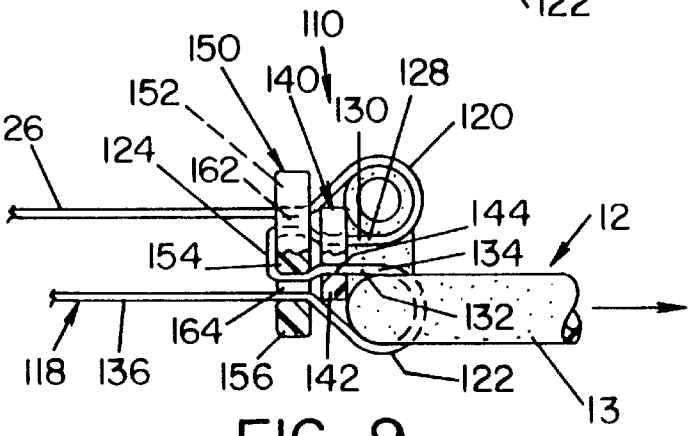
FIG. 9 is a side elevation, partially in section, depicting the embodiment of the connector shown in FIG. 8.
Figure 10:
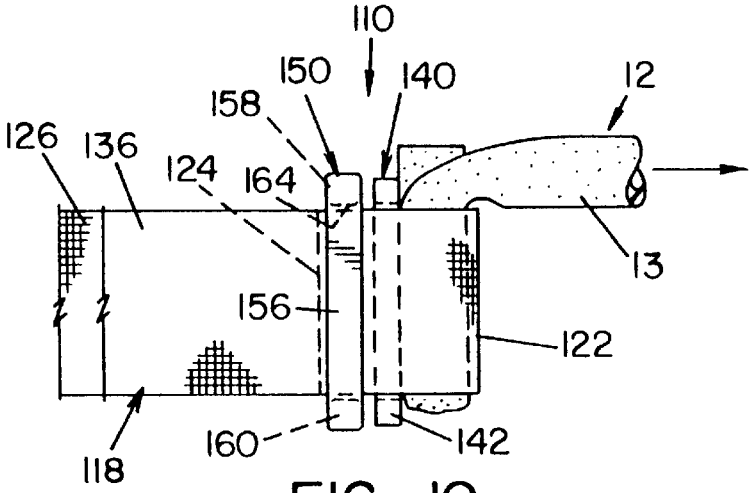
FIG. 10 is a side elevation of the connector depicted in FIG. 9.

A second embodiment of a connector for securing an extensible member is specifically depicted in FIGS. 8–10 and is indicated generally by the numeral 110. The connector 110 may be used with the same applications described above with respect to the first embodiment of the present invention. The connector 110 is formed in a section of flexible material 118 and generally includes a pair of cinchable loops 120, 122. An extensible member 13 is secured by the connector 110 by first passing the member 13 through one of the loops 120, 122 and then back through the other of the loops 120, 122. The loops 120, 122 are then cinched on the extensible member 13 to secure it.

As in the first embodiment of the present invention, the first 120 and second 122 cinchable loops are joined by a third loop 124. However, the third loop 124 in the second embodiment of the present invention has a variable circumference. The first cinchable loop 120 has a first end 126 and a second end 128. The second end 128 of the first loop 120 is connected to a first end 130 of the third loop 124. A second end 132 of the third loop 124 is connected to a second end 134 of the second cinchable loop 122. A first end 136 of the second loop 122 and the first end 126 of the first loop 120 may be joined if desired (see FIG. 11).

The circumference of the third loop 124 is not constant because the ends 130, 132 of the third loop 124 are slidably restrained by a ring 140 that functions as a restraint. Ring 140 has a frame 142 which substantially surrounds a ring opening 144 through which the ends 130, 132 of the third loop 124 are passed. The ring 140 thus maintains the integrity of the third loop 124 and prevents the first 120 and second 122 cinchable loops from being pulled out of a slide 150. The invention contemplates that any of the numerous structures known in the art may be used to slidably restrain the ends 130, 132 of the third loop 124.

The slide 150 includes three rails 152, 154, and 156 joined by two stiles 158, 160 to form two distinct openings 162, 164. Each opening 162, 164 is generally configured to match the cross section of the material 118 which is used to form the connector 110.

The loops 120, 122, and 124 are formed by passing the material 118 through the first opening 162 in the slide 150 and then through the opening 144 in the ring 140. The material 118 is then passed back through the first opening 162 of the slide 150 and then through the second opening 164 of the slide 150. The material 118 is next passed back through the ring opening 144 and lastly back through the second opening 164 of the slide 150. Such a sequence forms the loops 120, 122, and 124 while allowing the position of the connector 110 to be moved along the material 118.

The extensible member 13 is secured by the connector 110 according to the following method. The extensible member 13 is first passed through a cinchable loop 120, 122 and then doubled over and passed back through another cinchable loop 120, 122. The first ends 126, 136 of the cinchable loops are then pulled away from the slide 150 causing the loops 120, 122 to cinch against the extensible member 13.

As may be seen in FIGS. 1 and 11–18, either type of connector 10, 110 may be used to connect an exercise member 12 to a variety of objects. In each drawing figure, only one embodiment of the connector 10, 110 of the present invention has been depicted but it is obviously contemplated that either embodiment of the connector 10, 110 may be used to form each configuration. In FIG. 1, one connector 10 is used to secure the exercise member 12 to a hand hold 14 while another connector 10 is used to secure the exercise member 12 to a door hold 16. These connectors 10 could be obviously substituted with connectors 110 without altering the operation of the device.

Figure 11:
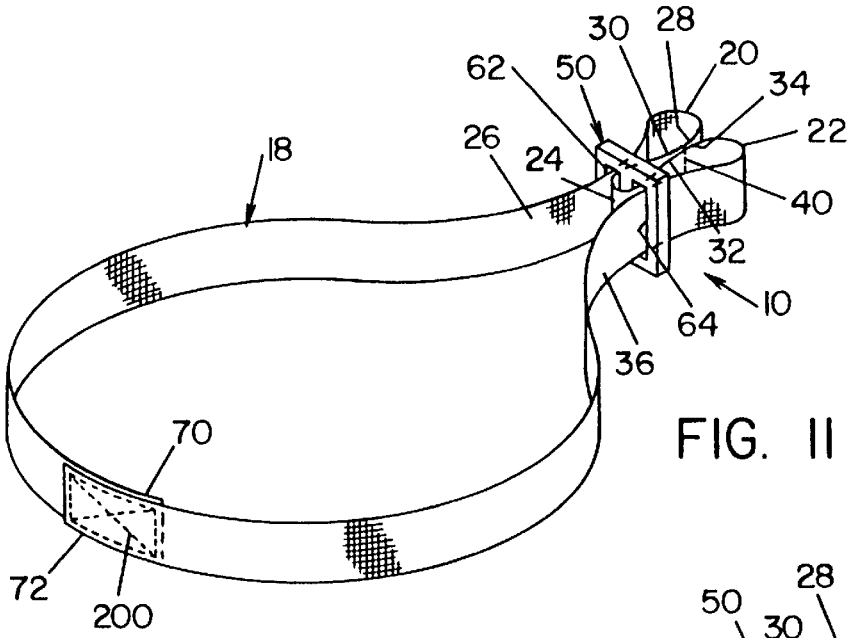
FIG. 11 is a perspective view of a connector incorporated into a permanently closed loop of flexible material.
Figure 12:
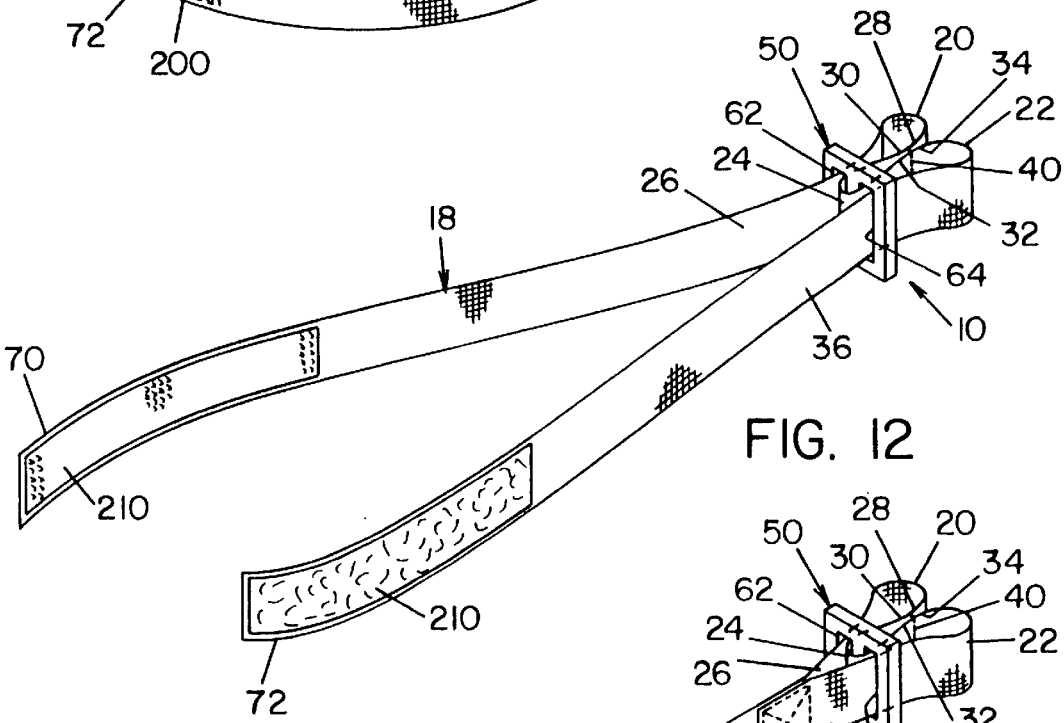
FIG. 12 is a perspective view of a connector incorporated into a selectively and adjustably closeable loop of flexible material.

In FIG. 11, a configuration is depicted in which the first ends 70, 72 of the material 18 are permanently joined by a connector such as stitching 200 to form a closed loop. A closed loop configuration has many applications such as a handle or a loop through which one may place his foot. In FIG. 12, the ends 70, 72 of the material 18 are selectively and adjustably joinable by opposed hook-and-latch synthetic materials 210 that adhere when pressed together, such as the commonly known embodiment sold under the trademark VELCRO®. The invention also contemplates that other connectors may be used to selective join the ends 70, 72. The selective and adjustable connector 210 allows the ends 70, 72 of the material 18 to be quickly and easily placed around a user's body parts such as the waist, neck, head, or thigh.

Figure 13:
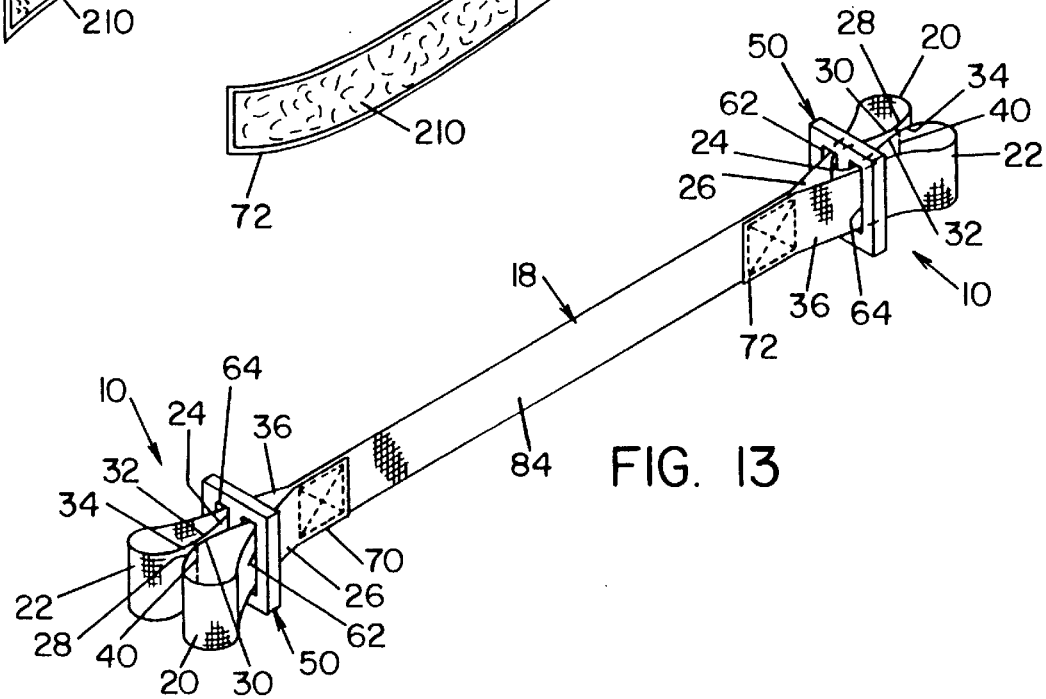
FIG. 13 is a perspective view of a section of flexible material incorporating a connector according to the present invention at each of its ends.

In FIG. 13, two connectors 10 are formed at opposite ends 70, 72 of a section of flexible material 18 by forming the connectors 10 and then connecting the ends 70, 72 back to a middle portion 84 of the material 18. Such a configuration may be useful as a foot hold with an extensible member secured by each connector 10 for use by each of the user's arms. It can also be used for neck exercises by positioning the head against the middle portion 84. This configuration may also be used in various other ways by a user, for instance, as an extension between two sections of exercise members 12. As such, the device depicted in FIG. 13 should not be limited to a handle or foot hold.

Figure 14:
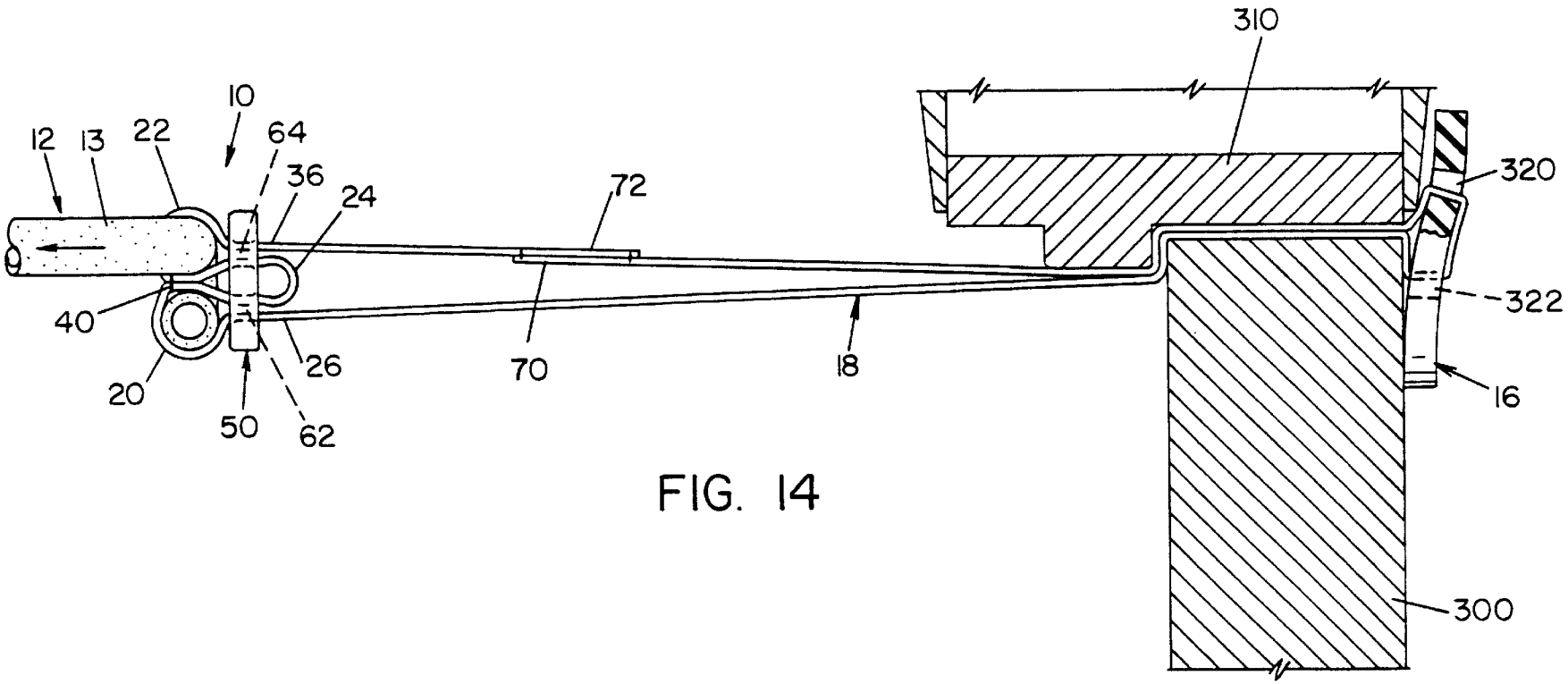
FIG. 14 is a top view, partially in section, of a connector according to the present invention used to anchor an exercise member to a door jamb.
Figure 15:
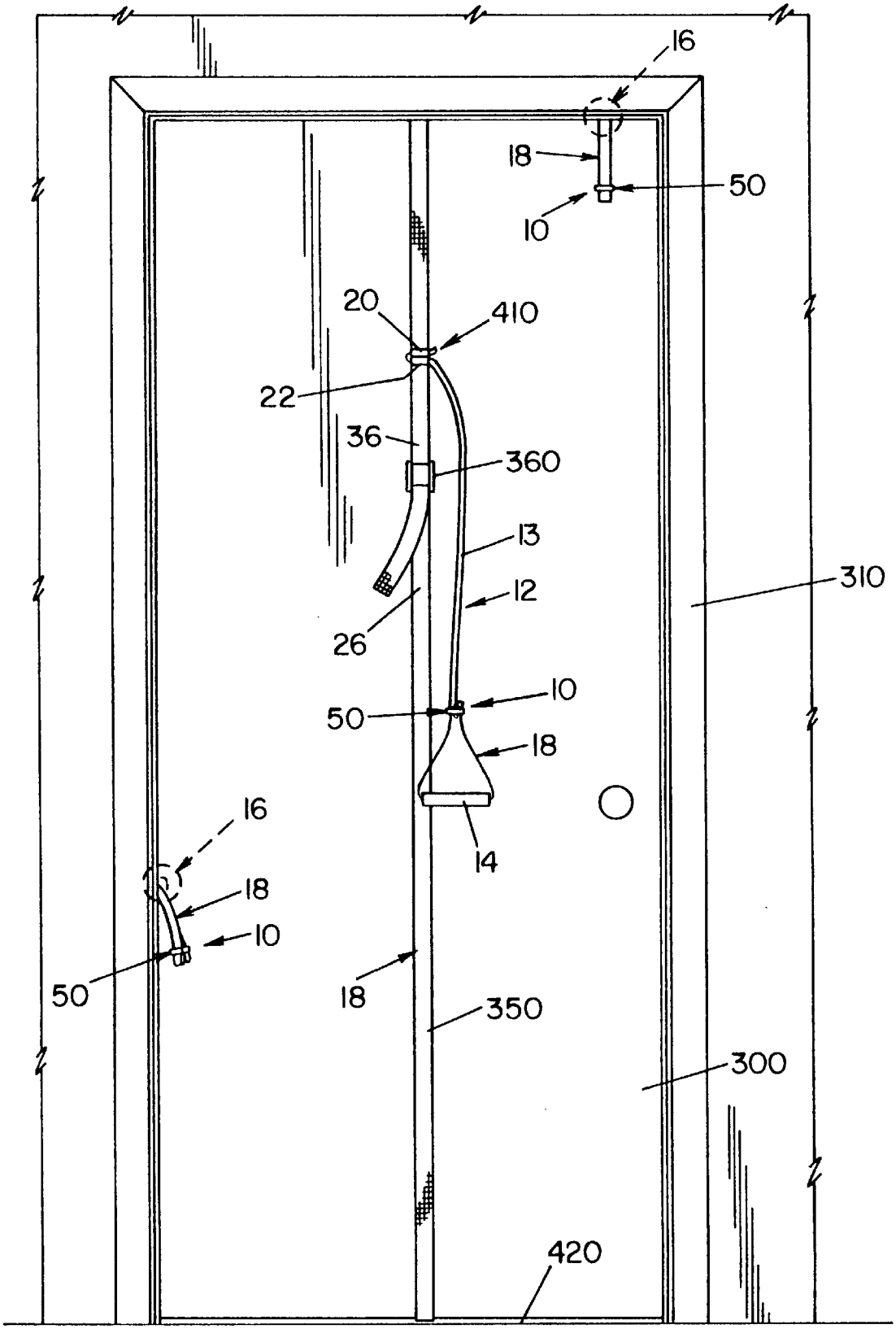
FIG. 15 is a front view of a door having a door band incorporating a connector according to the present invention, the figure also depicting two connectors being used in conjunction with door holds.

FIG. 14 depicts the use of a door hold 16 with a typical door 300 and door jamb 310. The door hold 16 may be preferably formed from a hard rubber or polymer substance having two openings 320, 322 through which the material 18 is passed. The door hold 16 is placed on the opposite side of the door 300 than the connector 10 and the door 300 is closed on the material 18. When a user exerts force against an extensible member 13, the door hold 16 is pulled against the door 300 and door jamb 310 and forms an anchor because the door hold 16 cannot fit through the space between the door 300 and the door jamb 310. One advantage of such a configuration is that the location of the connection may be easily adjusted or moved to different positions around the door jamb 310 as depicted in FIG. 15.

In FIGS. 15–18, the connectors 10, 110, 410 of the present invention are depicted in conjunction with door bands 350. The door bands 350 are formed by providing a sufficient length of flexible material 18 at the first ends 26, 36 of the cinchable loops 20, 22 to extend around the entire height or width of the door 300. A clamp 360 is connected to one end 26 of one of the loops 20, 22 so that the door band 350 may be adjustable and easily secured to doors 300 of various sizes.

Figure 16:
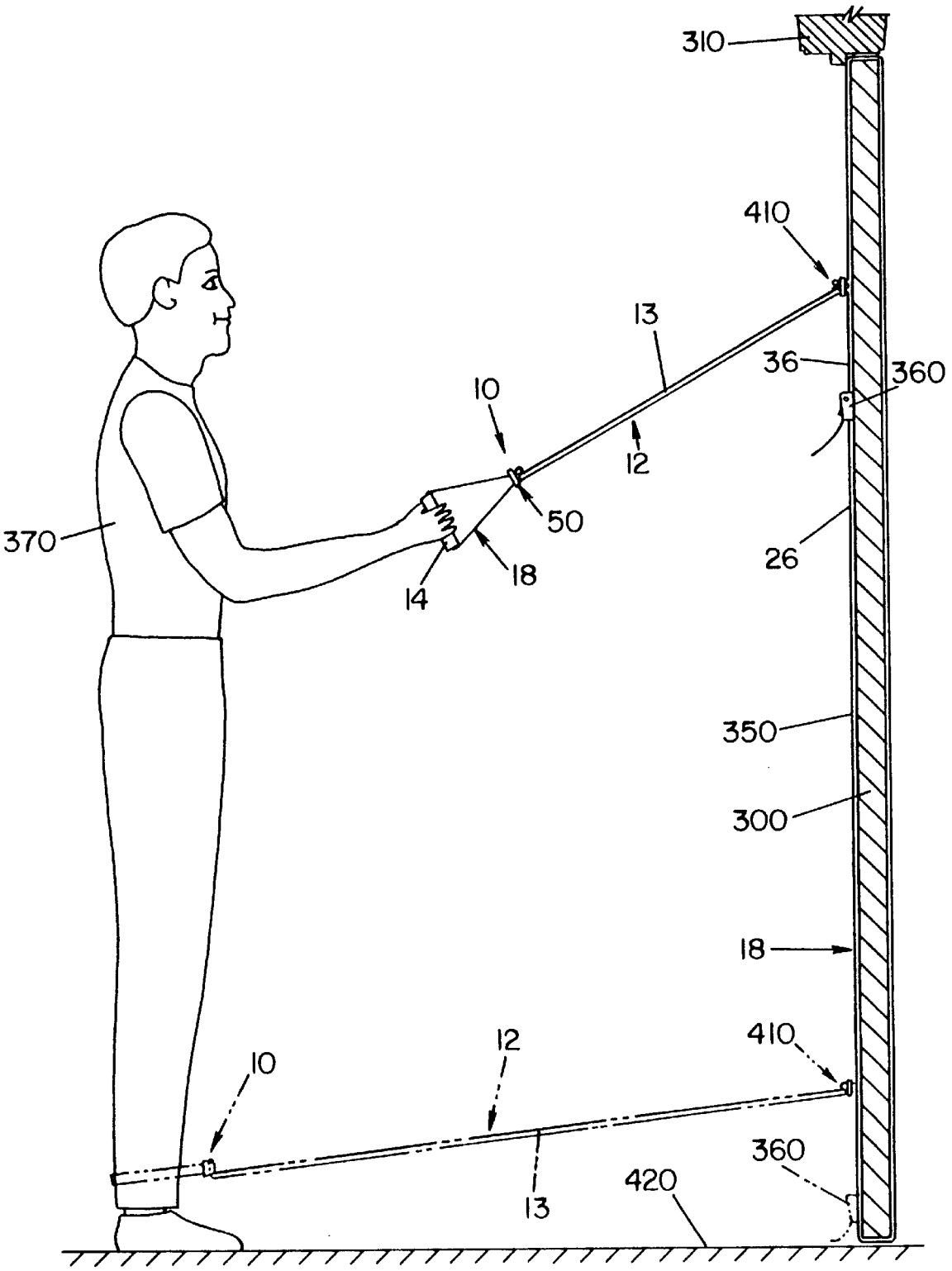
FIG. 16 is a side elevation, partially in section, depicting a person using an exercise device anchored to a door with a connector incorporated into a door band.
Figure 17:
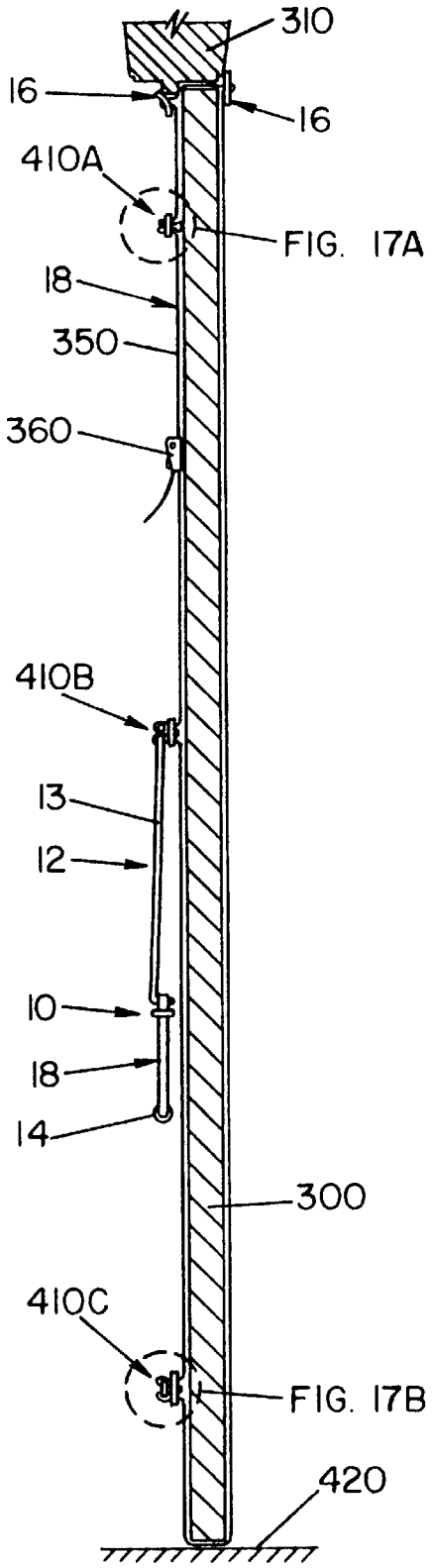
FIG. 17 is a side elevation, partially in section, depicting a door including a door band having multiple connectors and two door holds.
Figure 17A:
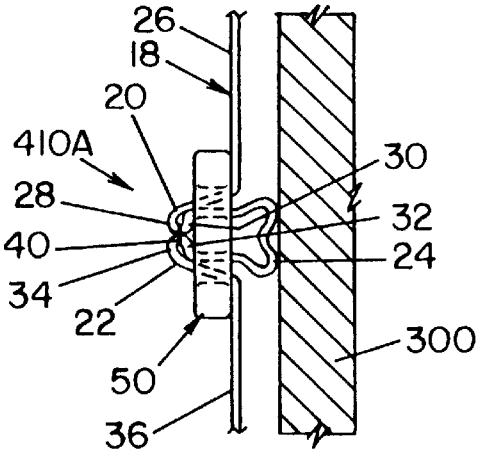
FIG. 17A is an enlarged view of one of the connectors depicted in FIG. 17.
Figure 17B:
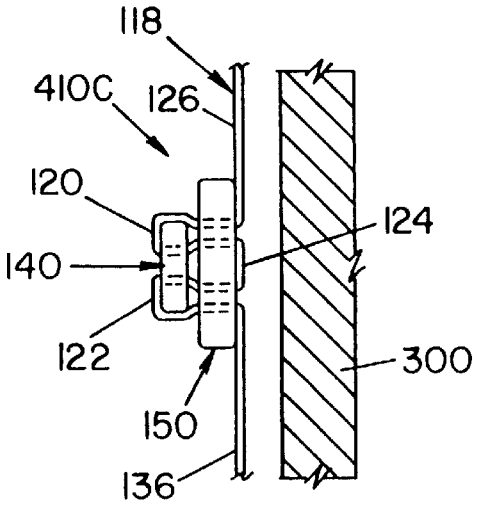
FIG. 17B is an enlarged view of another of the connectors depicted in FIG. 17.
Figure 18:
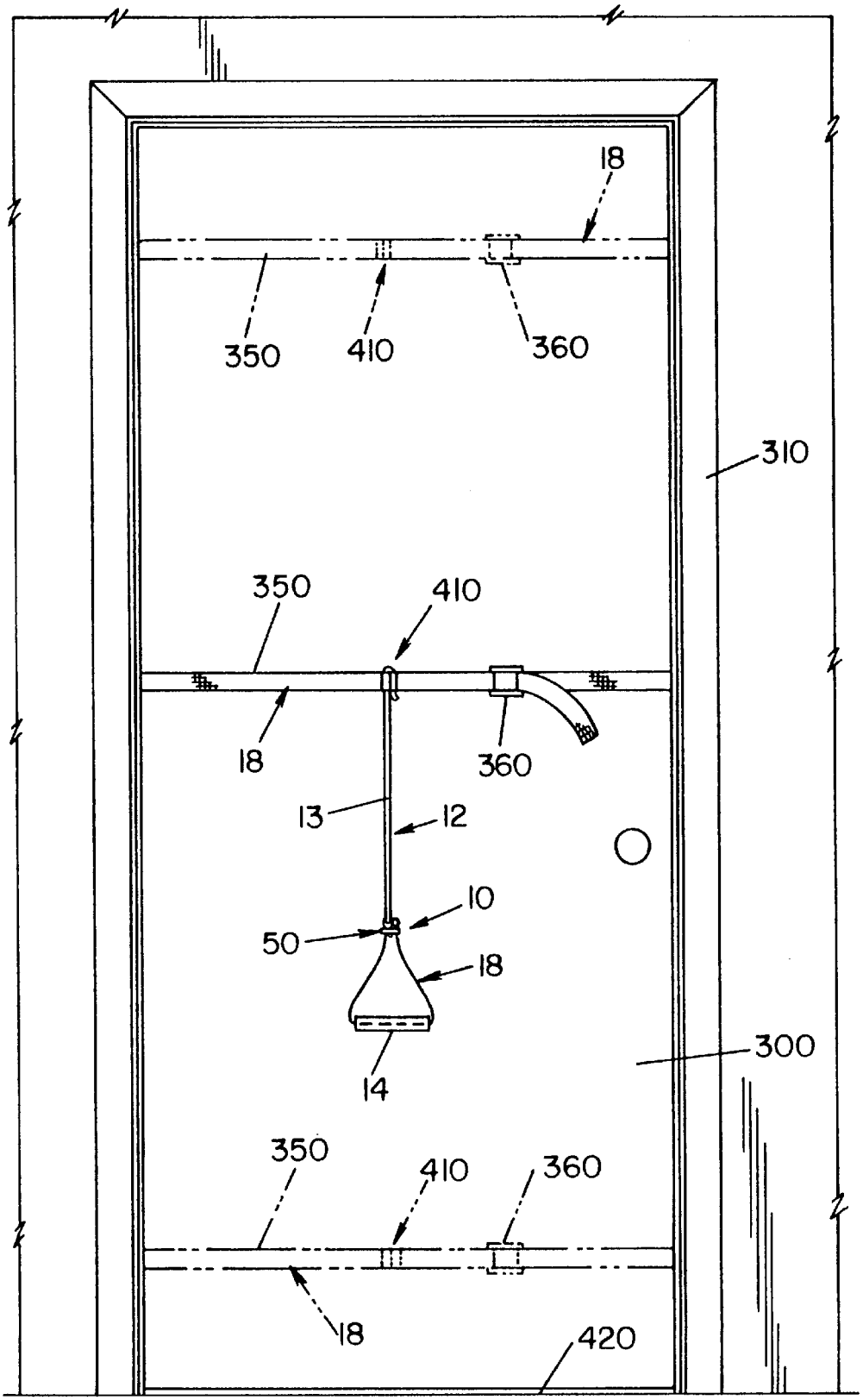
FIG. 18 is a front elevational view of a door including a horizontal door band.

As may also be seen in FIG. 16, the door band 350 allows the user 370 to position a connector 410 at any height along the door 300 as shown by the phantom lines. The user 370 may thus exercise different muscle groups by positioning the connector 410 at different levels of the door 300. To adjust the position of the connector 410, the user 370 simply rotates the entire door band 350 around the door 300. It is thus desirable to position the connector 410 adjacent the clamp 360 so that the clamp 360 does not become jammed between the door 300 and the door jamb 310 or the floor 420 when the door band 350 is rotated. Multiple connectors 410A, 410B, 410C, may also be formed in door band 350 as may be seen in FIG. 17. Both types of connectors 410A and 410C are depicted in FIGS. 17A and 17B. It may also be desirable to add a door hold 16 to the band 350 to prevent the band 350 from slipping around the door 300. A door hold 16 positioned at the rear (inside) of the door 300 prevents the door band 350 from rotating when the user exerts force downwardly on the door band 350. Similarly, a door hold 16 may be positioned at the front (outside) of the door 300 to prevent rotation when the user 370 applies force upwardly on the door band 350. The door band 350 may also be wrapped around the width of the door 300 as may be seen in FIG. 18.

When a connector 410C having a ring 140 is used with a door band 350, the connector 410C may be slid along the length of the door band 350. Such an adjustment may be accomplished by sliding the material 118 through the ring 140 and slide 150 to thereby reposition the connector 410C.

Figure 19:
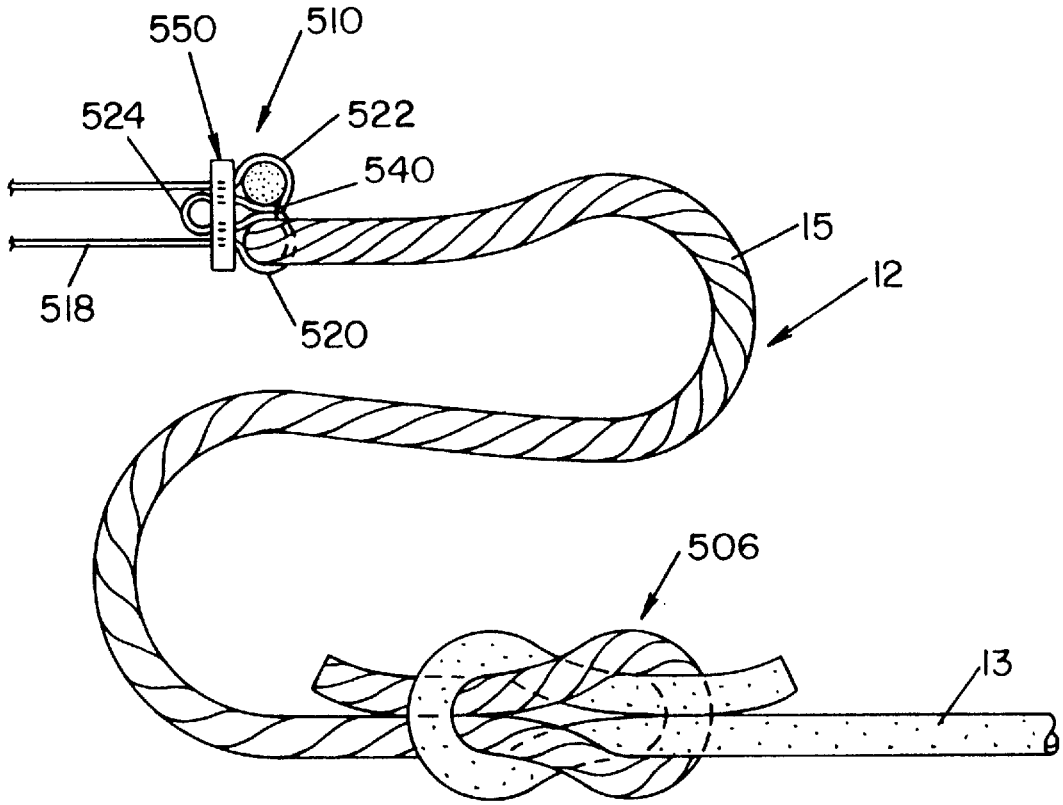
FIG. 19 is a side elevation depicting a further embodiment of the connector of the present invention cinched on an inextensible member.
Figure 20:
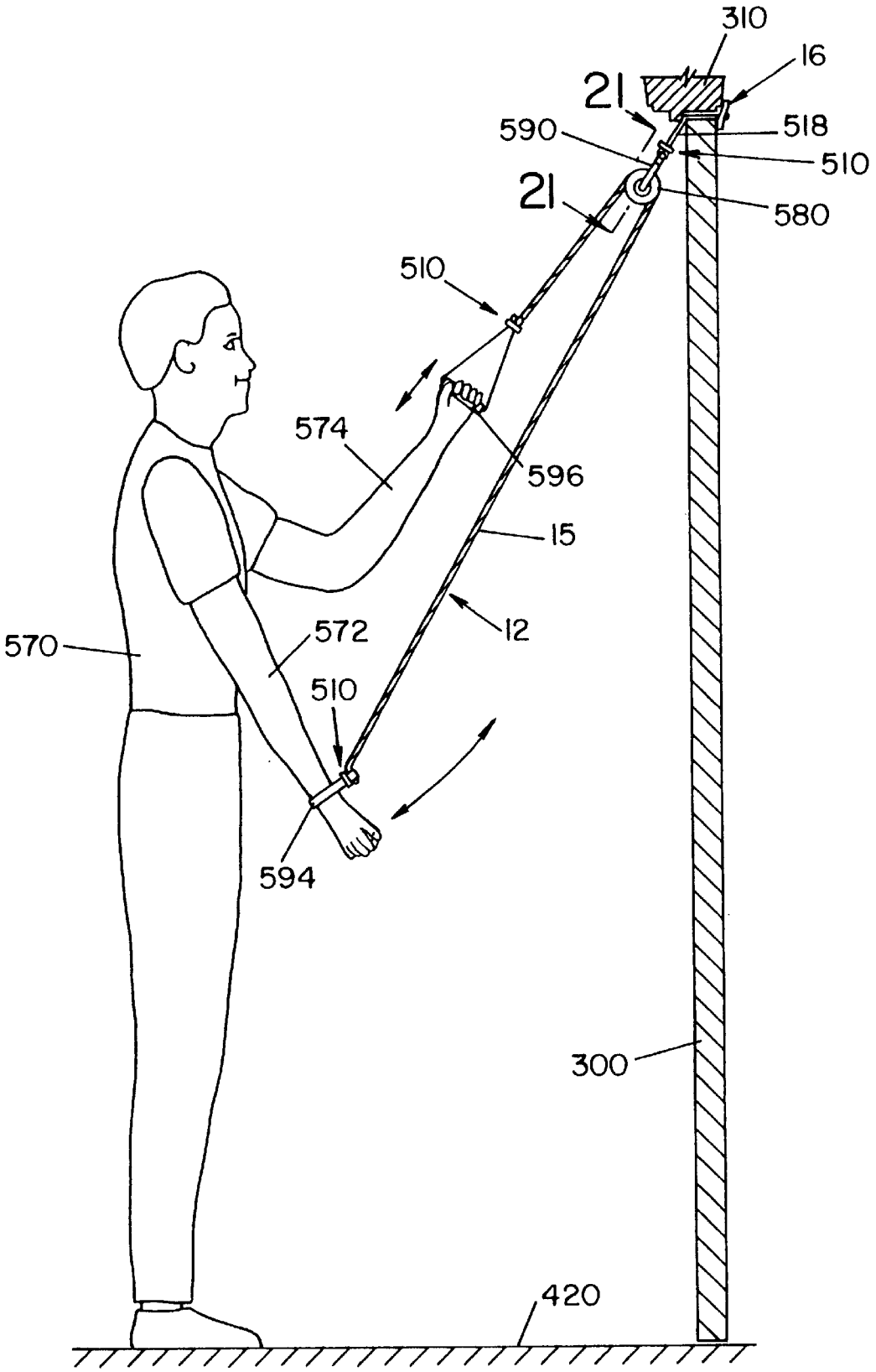
FIG. 20 is a side elevation, partially in section, depicting a person using an exercise device anchored to a door at least partially with a connection formed by a connector cinched on a metal bar.

With reference now to FIG. 19, a connector 510 is depicted in cinched on an inextensible member 15 such as a rope. The connection between the rope 15 and the connector 510 is formed in the same way as a connection between a connector 10 and an extensible member 13. As such, the inextensible member 15 is passed through a pair of loops 520 and 522. The loops 520, 522 are joined by a third loop 524. The loops 520, 522, 524 are formed in a flexible material 518 in conjunction with a slide 550 that is similar to the slide 50 described above. Also as described above, the ends of the third loop 524 are restrained by a restraint 540 that is depicted in FIG. 19 as a plurality of stitches. Of course, other restraints 540 may be effectively used on the place of the stitches as described hereinabove.

A connector 510 may be used to secure an inextensible member 15 for a variety of reasons. One such reason is when an extensible member 13 is joined to an inextensible member 15 by such means as a knot 506. This may be desirable to increase the overall length of an exercise device without changing the resistance of the device. Another reason is to use an exercise device similar to the device depicted in FIGS. 20 and 21. In such a device, a user 570 lifts one arm 572 with the other arm 574 using a pulley 580 and an inextensible member 15. Such an exercise is especially useful for a patient who as a paralyzed arm 572 that must be periodically moved to prevent further damage to the shoulder.

The pulley 580 is carried by a S-hook 590 that has a bar 592 onto which a connector 510 is cinched. The pulley 580 is anchored to the door 300 by a door hold 16 that is carried by a flexible material 518. The inextensible member 15 is threaded through the pulley 580 and a wrist band 594 is attached to one end and a handle 596 connected to the other end. Thus, when the user 570 pulls down on the handle 596, the wrist band 594 is pulled upwardly. The weight of the arm 572 will pull the handle 596 back to the beginning position when the user 570 stops pulling.

Another variation for the inextensible member would be to connect a different type of extensible member, such as a wire tension spring, to a handle or anchor as described herein. Although a spring cannot be received by the connectors 10 or 110, it could be first connected to a rope 15, in a suitable manner not shown, and then the rope end can be secured within the connector to provide a handle, anchor or the like, as described herein.

Thus, it can be seen by those skilled in the art, that a connector according to the present invention is useful for securing an exercise member to a section of flexible material. It should also be apparent that such a connector may be easily incorporated into a wide variety of exercise device configurations using both extensible members, as well as inextensible members, or both. Moreover, it is to be understood that all of the embodiments of slides, restraints, anchors, handles and the like can be utilized interchangeably with inextensible members in lieu of the various extensible members depicted in the drawings.

Based on the foregoing descriptions, it should now be apparent that the use of the connector described herein will carry out the objects set forth hereinabove. It should be apparent to those skilled in the art that the present invention can be practiced with a variety of differing types of materials and with materials of differing sizes. Furthermore, it should be apparent that the exemplary embodiments described in this specification may be modified in various ways to those skilled in the art without departing from the concepts of the present invention.

It is thus evident that all variations fall within the scope of the claimed invention; therefore, the selection of specific materials as well as specific configurations can be determined without departing from the spirit of the present invention. Moreover, the scope of the present invention shall include all modifications and variations that fall with the scope of the attached claims.

What is claimed is:

1. In combination, a slide and a flexible member providing a connector for securing an exercise member to said flexible material, the connector comprising:

first and second cinchable loops formed in said flexible material in cooperation with said slide;

a third loop connecting said first and second cinchable loops;

said third loop having a first end and a second end; and a restraint attaching said first end and said second end of said third loop together in unison to provide for a substantially constant circumference for said third loop;

said first and second cinchable loops being adapted to receive a portion of said exercise member.

2. A combination according to claim 1, wherein said restraint comprises a ring having a frame surrounding a ring opening, said first end and said second end of said third loop being slidably disposed in said ring opening.

3. The combination according to claim 1, wherein each of said first and second cinchable loops has a first end and a second end, said first ends of said cinchable loops being connected.

4. The combination according to claim 1, further comprising a door hold communicable with said flexible material, allowing said connector to be held by a door, against which the exercise member also held by said connector can be stretched and relaxed.

5. A combination according to claim 1, wherein each of said first and second cinchable loops has a first end and a second end, said first ends of said cinchable loops being selectively and adjustably connectable.

6. The combination according to claim 1, wherein said slide comprises first, second and third rails connected by two stiles to form first and second openings in said slide.

7. The combination according to claim 1, further comprising a clamp carried by one end of said flexible material.

8. The combination according to claim 1, wherein said exercise member comprises an extensible member.

9. A combination according to claim 1, wherein said exercise member comprises an inextensible member.

10. In combination, an exercise member, a slide and a flexible material, said slide and flexible material forming a connector for securing said exercise member, the combination comprising:

first and second cinchable loops formed in said flexible material in cooperation with said slide;

a third loop connecting said first and second cinchable loops;

said third loop having a first end and a second end;

a restraint holding said first end and second end of said third loop;

said exercise member passing through both of said first and second cinchable loops.

11. The combination according to claim 10, wherein said restraint comprises means for attaching said first end of said third loop to said second end of said third loop.

12. The combination according to claim 10, wherein said restraint comprises a ring having a frame disposed about a ring opening, said first end and said second end of said third loop being slidably disposed in said ring opening.

13. The combination according to claim 10, wherein said first and second cinchable loops are cinched on said exercise member.

14. The combination according to claim 10, wherein said exercise member comprises an extensible member.

15. The combination according to claim 14, wherein said exercise member comprises a hollow elastic tube.

16. The combination according to claim 14, wherein said exercise member comprises an elastic band.

17. The combination according to claim 14, wherein said exercise member comprises an inextensible member.

* * * * *